United States Patent [19]

Jones

[11] Patent Number: 4,673,338

[45] Date of Patent: Jun. 16, 1987

[54] TRAVELLING BARREL DOWN HOLE PUMP HAVING A GAS RELIEF PROBE

[76] Inventor: William A. Jones, P.O. Box 621, Lotus, Calif. 95651

[21] Appl. No.: 850,139

[22] Filed: Apr. 10, 1986

Related U.S. Application Data

[63] Continuation-in-part of Ser. No. 688,029, Dec. 31, 1984, abandoned.

[51] Int. Cl.[4] ..... F04B 21/04

[52] U.S. Cl. ..... 417/435; 417/554

[58] Field of Search ..... 417/435, 443–445, 417/545, 552–554

[56] References Cited

U.S. PATENT DOCUMENTS

| | | | |
|---|---|---|---|
| 880,019 | 2/1908 | Futhey | 417/554 |
| 1,771,690 | 7/1930 | Rankin | 417/445 |
| 2,005,299 | 6/1935 | Penrod | 417/459 |
| 2,690,134 | 9/1954 | Ritchey | 417/443 |
| 3,215,085 | 11/1965 | Goosetree | 417/444 |

*Primary Examiner*—William L. Freeh

*Attorney, Agent, or Firm*—Mark C. Jacobs

[57] ABSTRACT

A downhole pump having a gas release probe which probe can be easily applied to a conventional travelling barrel downhole pump by merely lengthening such barrel by providing a variable length spacing sleeve above the travelling valve. The trip rod of the probe lifts off the valve element of the valve from its valve seat to release any gas or foamy oil otherwise trapped between the lower standing valve and the upper travelling valve of the pump. The invention is useful for obtaining oil under subterranean formation conditions that do not normally permit such recovery efficiently due to gas locks and can be either provided in a downhole pump or added to a preexisting pump.

The term variable length spacing sleeve is used to describe a spacing sleeve whose length is established to suit a particular operating environment, and which length is determinable by one skilled in the art after considering the various operating parameters of the oil well in question.

9 Claims, 4 Drawing Figures

TRAVELLING BARREL DOWN HOLE PUMP HAVING A GAS RELIEF PROBE

RELATION TO OTHER APPLICATIONS

This application is a continuation in part of my copending application Ser. No. 688,029 filed 12/31/84 and now abandoned.

BACKGROUND OF THE INVENTION

1. Field of the Invention

The invention relates to apparatus for pumping oil wells, and, more particularly, to gas release apparatus for oil well pumps.

2. Description of the Prior Art

Production of oil from oil wells is usually accompanied by some of the gas in the well flowing through the down hole pumps. If this gas is allowed to accumulate in the barrel of the down hole pump, a condition known as "gas lock" occurs. Such a condition occurs when foamy oil or surges of subterranean gases become trapped between the travelling valve fixed to the upper barrel of the downhole pump and the standing valve fixed to the plunger or piston pull tube and seating nipple or shoe of the pump. In such a condition, little if any fluid can be pumped out of the well. The down hole pump may simply be compressing and expanding the gas that is locked in the barrel, Hydrostatic pressure of the column of fluid, when the column is generally several feet in height, bearing on the travelling valve, causing the trapped gases to compress and decompress. This keeps the travelling valve and the standing valve closed preventing the pump from working.

The nature of valves used in existing down hole oil well pumps lends itself to the creation of gas locks. Normally, the pressure differential across the travelling ball valve during the downward stroke opens the valve and allows the fluid in the pump barrel to escape into the discharge tubing. If the fluid in the pump barrel is mostly gas, the travelling ball valve may not open. Thus, as heretofore stated, the pump will not be operating properly and little if any fluid will be flowing into the discharge tubing.

In the past, it has been suggested to remedy such condition by preventing gas from reaching the pump. This was accomplished by using an annulus below the pump inlet. However, in order to implement such a remedy, accurate data is required about the generally unknown formation characteristics. Furthermore, the fluid reservoir characteristic of such formations change with time, requiring constant adjustments to the pump installations. Therefore, the annulus method of preventing gas from reaching the pump is neither practical or effective.

In U.S. Pat. No. 1,676,186 to Hawkins, a valve control for plunger-type pumps is disclosed. However, this arrangement depends on precise spacing of the internal parts which is quite impractical. In U.S. Pat. No. 1,067,312 Conrader, a pump is disclosed for pumping gas. Again, spacing is quite critical and no provision is made to prevent gas lock. Also, such apparatus cannot pump positively on each cycle. In U.S. Pat. No. 1,793,572 to Von Linde, a tubing check valve for a pump is disclosed. Such apparatus is quite expensive and no positive way of unseating the check valve is disclosed. These prior art devices are relatively impractical to implement and are quite costly.

Other approaches to the problems found in oil production have also been patented. None of these however can succeed because they fail to take into full consideration the operating parameters that are present at each and every well.

Goosetree, U.S. Pat. 3,215,085 discloses the lifting of a valve of a valve piston to reduce fluid pounding. He employs a standing valve assembly at the bottom of a pump, which valve assembly has a stationary projection which engages a ball when the plunger descends. His barrel however is not of the travelling variety. Goosetree suffers from the failure to adequately provide a factor for the reality of well operation. He fails to compensate for the fantastic differences in oil well depth which can range into the thousands of feet, among other idiosyncrasies of individual wells by utilizing a fixed design suitable for any and all wells. Thus upon using his device, a well operator would find that there would be times when the rod would not engage the valve member and there would also be times when the travelling valve cage would strike and impact the rod support of the standing valve. Of course it must be born in mind that the pump style of Goosetree is not of the travelling barrel type.

There is thus a need in the industry for travelling barrel type pump that can eliminate the gas lock problem, by allowing dissipation of gas on every single stroke of the pump.

SUMMARY OF THE INVENTION

In light of the above well understood need, it is an object of this invention to provide a gas release probe on a travelling barrel oil pump.

It is another object to provide an apparatus for the elimination of gas lock in travelling barrel oil well pumps.

It is yet another object of the invention to provide a gas release probe for retrofit usage as well as for incorporation into new travelling barrel oil pumps.

Other objects of the invention will in part be obvious and will in part appear hereinafter.

The above and other objects are preferably carried out by providing a travelling barrel type pump that incorporates an upper barrel spacing sleeve above the travelling valve, which spacer sleeve has a seat retaining base normally disposed therein along the elevation thereof but distant from the top thereof.

The trip rod of the probe lifts the valve element, usually a ball, off the seat in the travelling valve to thereby release any gas or foamy oil that is trapped between the lower standing valve and the upper travelling valve of the pump. The structure permits the release action to take place on each and every stroke of the pump.

The invention accordingly comprises the apparatus possessing the construction, combination of elements and the arrangement of parts which are exemplified in the following detailed disclosure and the scope of the application of which will be indicated in the claims.

For a fuller understanding of the nature and objects of the invention, reference should be had to the following detailed description taken in conjunction with the accompanying drawings.

DESCRIPTION OF THE PREFERRED EMBODIMENT

Figure 1:
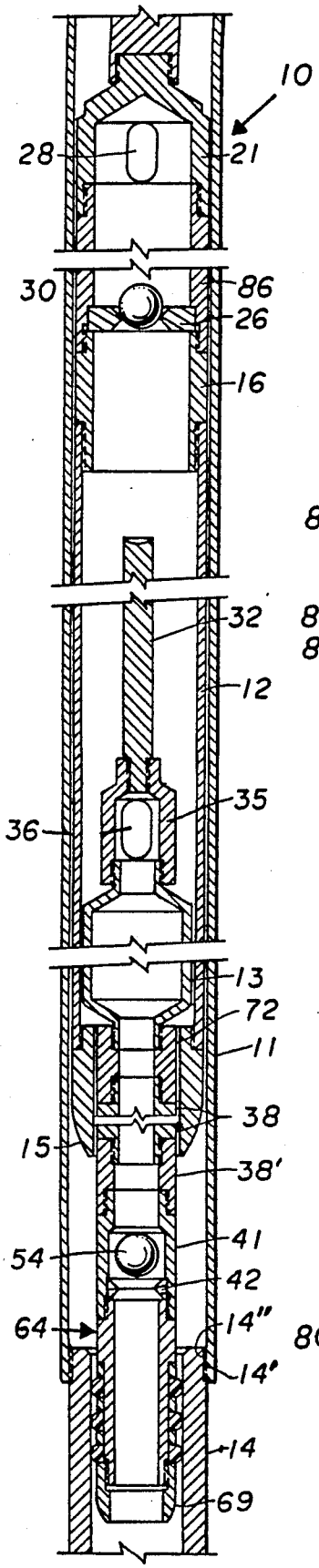
FIG. 1 is a vertical cross-sectional exploded view of a downhole pump incorporating a gas release probe in accordance with the teachings of the invention shown in upstroke position.

Referring now to FIG. 1 of the drawing, a downhole pump 10 for pumping an oil well into which tubing 11 is extending is shown. Pump 10 includes an elongated travelling barrel 12 having a plunger 13 disposed interiorly thereof. A seating nipple 14 is threaded to the lower end of tubing 11 via mating threads 14' (FIG. 1) on nipple 14 and threads 14" on the lower end of tubing 11. It is to be understood that the tubing 11 extends from the surface down into fluid communication with the reservoir from which oil or gas is being pumped.

Figure 2:
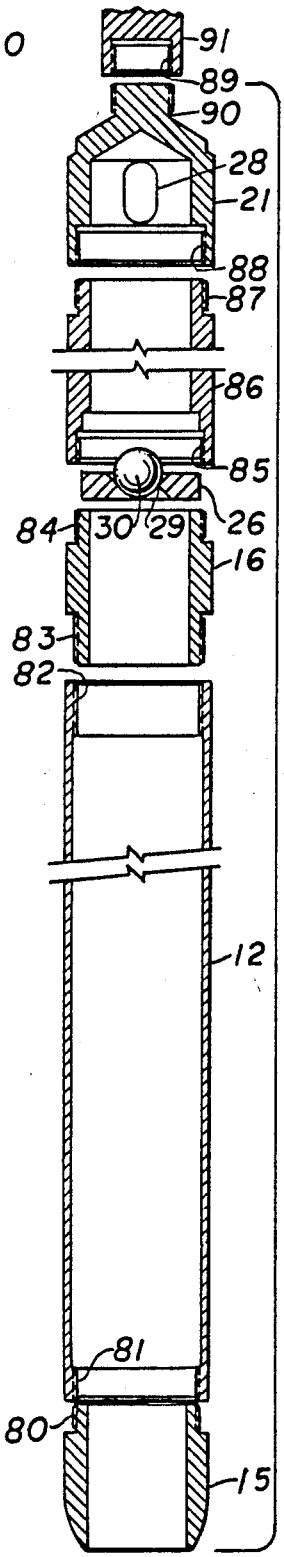
FIG. 2 is an exploded view of the travelling valve portion of the apparatus of FIG. 1.
Figure 3:
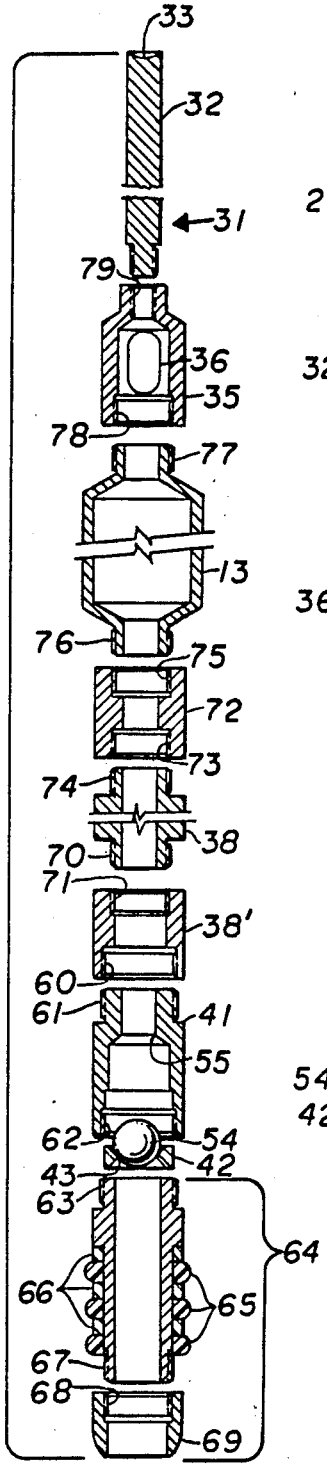
FIG. 3 is an exploded view of the standing valve portion of the apparatus of FIG. 1.

The barrel 12 includes a guide bushing 15 (FIG. 2) at the bottom threaded on the interior wall thereof to act as a guide for travelling barrel 12 up and down pull tube 38. As seen in FIG. 3, adapter 38' is threaded, via threads 60, to mating threads 61 on a closed cage 41. Cage 41 is in turn threaded, via threads 62, to threads 63 at the upper end of a conventional seating assembly 64.

Seating assembly 64 is provided with one or more seating cups 65 separated by spacing rings 66, as is well known in the art. Assembly 64 is threaded at threads 67 at its lower end to mating threads 68 on a conventional compression nut 69.

As seen in FIG. 1, and as can be appreciated by comparing FIG. 1 with FIG. 3, a standing valve seat 42 is mounted between cage 41 and assembly 64 retained therein by the engagement of threads 62, 63. A conventional ball 54 is provided on valve seat 42 within cage 41.

A variable length pull tube 38 is threaded (FIG. 3) via threads 70 to mating threads 71 on adapter 38'. An adapter 72 couples plunger 13 to pull tube 38. Adapter 72 has threads 73 at one end mating with threads 74 on pull tube 38, which is hollow, and threads 75 at the other end mating with threads 76 on plunger 13. The upper end of plunger 13 has threads 77 mating with like threads 78 on upper cage 35. Cage 35 has an opening 36 therein and includes a gas release probe 31, in the preferred form of a solid rod, screw threaded into a threaded aperture 79 in the top of cage 35.

The apparatus heretofore described and illustrated in FIG. 3 is the standing assembly portion of the total apparatus shown in FIG. 1. The travelling assembly portion of the total apparatus of FIG. 1 is shown in exploded view in FIG. 2. Thus, as seen in FIG. 2, the aforementioned guide bushing 15, which is shown in FIG. 1 as riding on the outer surface of pull tube 38, is threaded, via threads 80, to mating threads 81 on a travelling barrel 12. Guide bushing 15 also acts as a pulling nut for the complete standing assembly of FIG. 3. Threads 82 on barrel 12 engage mating threads 83 on an optional but preferably utilized adapter 16 coupling the upper barrel spacing sleeve 86 to the travelling barrel 12. The adapter 16 is threaded, via threads 84, to mating threads 85 on a variable length spacing sleeve 86. The term variable length as utilized here is intended to mean that the length of the actual sleeve used in any one well may differ from the length of the sleeve in any other well. The determination of the length to be used is dependent upon the operating parameters of the particular well in question and will be discussed below. The skilled artisan, after giving due consideration to the well parameters, can then determine how long to make the sleeve 86 to avoid pounding, and to release trapped gas on every stroke of the pump.

As seen in FIG. 1, a valve seat 26 is wedged in position between the mating threaded ends of adapter 16 and the sleeve, when they are engaged. A ball 30 is loosely disposed in sleeve 86.

If an adapter is not employed, then the valve seat must be disposed within the upper barrel spacing sleeve, but distant from the top thereof. Such a construction is within the skill of the art, but is probably a more costly one than the interpositon between the adapter 16 and the sleeve 86.

The upper end of sleeve 86 is threaded, at threads 87, for mating threaded engagement with threads 88 on an open cage 21, having one or more openings 28 therein, providing discharge ports as in well known in the art, completing the top of the travelling assembly of FIG. 2. The travelling assembly of FIG. 2 is adapted to be threaded, via threads 89, on the upper neck 90 thereof, to a well sucker rod 91 extending up through tubing 11 to the well head at the surface.

It can be seen in FIGS. 1 and 2 that seat 26 also has a central opening 29, which may taper to a point, providing a seat for the ball valve 30 of the travelling assembly. Ball valve 30 is adapted to engage the top of the gas release probe 31 (FIG. 3) in accordance with the teachings of the invention. Probe 31 includes a solid rod 32, terminating at its upper end in a concave portion 33 (FIG. 3) for conforming to the shape of ball 30 providing a seat therefor. Rod 32 extends from the top of cage 35 which cage 35 also has one or more elongated openings 36 (only one being visible) providing discharge ports.

While a ball valve is shown, obviously a valve using a flat disk is also contemplated by the invention.

Ball valve 54, similar to ball 30, is provided in the lower or standing valve or cage 41 (FIG. 1) adapted to close off opening 43 in seat 42. A reduced neck portion 55 is provided at the top of cage 41 for limiting upward movement of ball 54.

The apparatus in FIG. 1, although it incorporates the teachings of my invention, may be comprised of conventional pump parts that are adapted to include the novel gas release probe of my invention.

Thus, cage 35 may be affixed with female screw threads at the top to gas release probe 32. It includes open discharge ports 36 and may include female screw threads at bottom for connection to a standard API plunger assembly 13. The length of sleeve 86 is not fixed so as to prevent any critical pump spacing problems. As is known in conventional reciprocating pumps, spacing depends on rod stretch, length of stroke and well depth. The sleeve 86 is preferably provided with male threads at top to connect to open cage 21 and female threads at bottom to connect to male threads of adapter 16. Of course this presupposes the use of the adapter 16 aforementioned. Otherwise, the adapter and the sleeve would be integrated into one piece.

The seat 26 is compressed and locked in place when the sleeve 86 is threaded to adapter 16, with ball 30 resting on seat 26, thus effecting a valve seal. Ball 30 can thus travel upwardly through the spacing sleeve 86 where its travel to the maximum, is stopped by the upper reduced end 90 of the open cage. Of course in actual operation, it never travels that far.

The length of the travelling barrel 12 may also be varied to suit the current operating parameters of the well in question. Some of the parameters to be considered are rod stretch, length of stroke and well depth. All of these parameters will be discussed in further detail infra.

The bottom end of the travelling barrel 12 is threaded to the barrel bushing 15 which is commonly used as a guide and a shoulder bushing to pull the stationary assembly, seen in FIG. 3, of the pump 10 with the travelling assembly of FIG. 2.

The overall length of the gas release probe 31 may vary for the same reasons discussed above. The probe 31 may be constructed of any suitable materials, such as stainless steel. Concave portion 33 may have a radius generally equal to the radius of ball 30 and rod 32 has a diameter less than the width of opening 29 for lifting and supporting ball 30 into the hollow interior of sleeve 86.

The bottom end of probe 31 is female threaded for connection to male threads on plunger (variable) 13.

Thus, my invention may be provided in the form of either a complete pump assembly, including the gas release probe, or as a separate probe which can be quickly and easily adapted to a preexisting downhole pump having a travelling barrel.

OPERATION OF THE INVENTION

Figure 4:
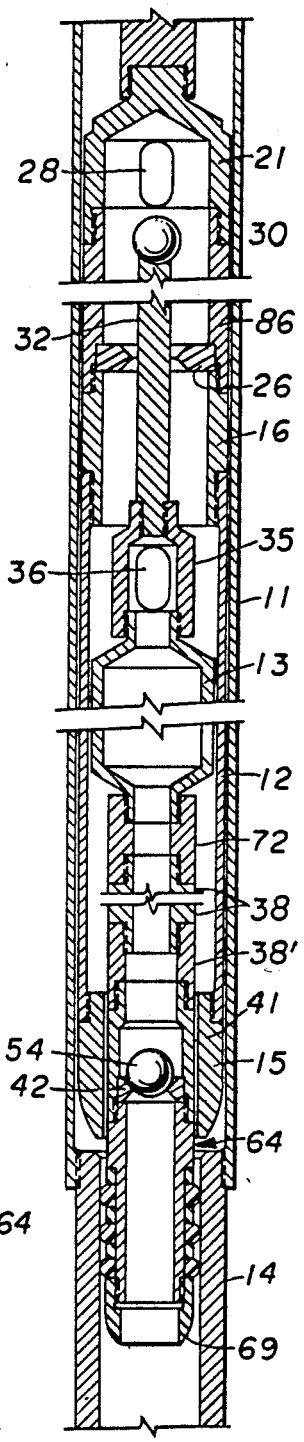
FIG. 4 is a vertical view, similar to FIG. 1 showing the pump in its downstroke position.

In operation, pump 10 is lowered down the well and seated in the shoe or seating nipple 14. The pump 10 is now in the downstroke position (FIG. 4). On the upstroke, the upper or travelling valve provided by ball 30 and opening 29 closes and the lower or standing valve provided by ball 54 and opening 43 opens to allow oil or fluid from the formation to enter past opening 43, about the ball 54 and up through tubing 38 in FIG. 1. In the downstroke position, FIG. 4, which is effected by gravity, the lower valve is closed when ball 54 seats in opening 43 and the upper valve opens forcing oil or fluid past opening 29 and out of openings 28 and in cage 21 through tubing 11 and up to the surface.

Gas release probe 31 mechanically unseats ball 30 on the downstroke when rod 32 engages ball 30 when the pressure of the compressed gas is inadequate to unseat the ball 30 of the upper travelling valve, provided by cage 21, ball 30, openings 28 and opening 29 in seat 26, against the pressure of the hydrostatic head. This releases gas trapped in barrel 12 to permit the same to escape to the well head.

By way of embellishment on the general operation of the device of this invention, the following should be noted as transpiring during the downstroke of a pump as shown in FIG. 4. The travelling barrel 12 moves downwardly and with it moves the travelling valve (cage 21 and its components) which supports the column of fluid in the tubing 11. The fixed rod 32 of probe 31 is of such a length that, at a specific point towards the end of the downstroke, it contacts the bottom of the ball valve 30, forcing it off the seat 26 allowing the transfer of fluid between the barrel 12 and the tubing 11. The length of the spacing sleeve 86 is sufficient to accommodate the length of the probe 31 without interfering with the full pump stroke. If the pump 10 is operating efficiently, the travelling valve will be already open by the time the gas release 31 contacts it. On the other hand, if the pump 10 is filled with a large amount of gas which prevents the development of sufficient pressure to open the valve 30 normally, the valve 30 will be opened by the probe. Although initially the fluid in the tubing 11 will move downwards into the barrel 12, since the pressure in the barrel is low, by the end of the downstroke the gas will have migrated upwards through the valve 30 and into the tubing 11 due to the density difference between the gas and the liquid. This process is repeated every pumping cycle thus insuring that there always occurs fluid transfer from the pump to the tubing. The presence of the probe 31 also affects the upstroke cycle since it delays the closing of the travelling valve 30 and the beginning of the influx of fluid from the formation through the standing valve 54 and into the barrel 12.

OIL WELL OPERATING PARAMETERS

As touched upon briefly above, there are many operational factors that must be considered in the designing of a pump system to quickly and efficiently remove oil from a well. Thus each pump is a custom job. The operating parameters effect the sizing of the probe and the size of the upper barrel spacing sleeve, and for that matter the travelling barrel itself.

An industry publication that is almost a Bible to the petroleum engineer is the publication entitled "Engineering Calculations for Sub-Surface Oil Well Pump Installations", published by Harbison-Fischer of Crowley, Tex. The inventor is familiar with the version published in 1979 though newer editions may be available. Another publication useful to one of skill in the art in designing a pump system, and the components thereof such as the travelling barrel and upper barrel spacing sleeve is the American Petroleum Institute's publication "Recommended Practice for Design Calculations for Sucker rod Pumping Systems".

Returning to the first mentioned publication, the reader notes a series of formulae all dealing with well production. These include Apparent Theoretical Pump Displacement and Actual Theoretical Pump Displacement. After these have been determined, from the formula $P=K\times S\times SPM$ . . . *wherein P is production in barrels, K is a pump constant determined from a lookup table and SPM is strokes per minute and S is the polished rod stroke in inches for the first equation and plunger stroke in inches for the second equation; then, the actual production can be calculated from the equation:*

A.P.=Actual Theoretical Pump Displacement-×Pump Volumetric Efficiency

However, other factors bear upon the entries into the formula above. Thus there is a set way of determining plunger stroke, the determination of which incorporates a set way of determining rod and tubing elongations as well as plunger overtravel [Plunger stroke=polished rod stroke−tubing stretch−overtravel].

This patent application is not intended to be a short course in oil well production engineering. Therefore the details of the above are deemed to be beyond the scope of this application. Suffice it to say that these factors, among others must be considered by the routineer in designing his or her pump and therefore in designing the length of the variable length upper barrel spacing sleeve and the probe used to push the valve off the seat into the spacing sleeve.

Some of the other operating parameters which can be mentioned in passing include well depth; oil viscosity; sucker rod stretch; size of pump; and even the nature of the rod string be they straight rods or tapered rods.

By reference to the aforementioned publication, the well operator can easily determine how long to make the gas relief probe and the upper barrel spacing chamber, once the size of the overall pump has been determined. Thus the artisan calculates the amount of travel of the travelling barrel, and how much in inches the gas relief probe has to move in order to raise the upper valve ball off of the seat and raise it into the cage, but without hitting the cage (pounding). Such calculations will be best understood by reference to the examples that follow.

Basically, the length of the upper barrel spacing sleeve is the "slop factor" that allows the operator to avoid the phenomenon of pounding, while releasing gas on every stroke.

The secret to the success of the invention is the fact that the valve seat for the upper valve is not at the base of the chamber as in prior art devices, but is distant therefrom; i.e. within the spacing sleeve or at the base thereof adjacent the adapter (if used), such that the ball has room to travel even as operating conditions on the well change, as they do, since wells are dynamic not static, and in such travel it is not lifted to the upper cage to bang. Reference is made to the various figures.

While the operating conditions of any particular well can change as frequently as on a daily basis, it is seen that it is within the skill of the artisan, after a careful review of the then current operating parameters, to readily determine the cushionable amount of distance needed for the travel of the upper valve (i.e. that minimum needed to avoid pounding) whereby he or she can set the needed length for the upper barrel spacing sleeve for that day's operating environment of the well in question.

Thus due to many years of oil field experience, and the carrying out of hundreds of operating parameter calculations, applicant is comfortable in stating that a 24 inch long upper barrel spacing sleeve would be comfortable with a 22 inch probe to achieve the goals of this invention for a 10,000 foot well, no matter how many of the parameters changes and by how much. On the other hand, for a given 5000 foot well, it is felt that a 12 inch upper barrel spacing sleeve in concert with a 10 inch probe-either with or without the small adapter in both instances—would give the desired results. This calculates out to an upper barrel sleeve increase in length of about 2.5" per 1000 feet of well depth, no matter the changes in operating parameters, to achieve gas relief.

In arriving at these determinations, applicant has considered the relationship of pump bore, rod sizes, tubing sizes, fluid gravity, well depth, pump speed, stroke length, rod stretch and over travel as they effect well operation and production. The formulae aforementioned, which are but several of many recited in the Harbison-Fischer book, and the effects of the various parameters, are as well known to a well production superintendent as is the action of yeast to a baker.

Prior to setting out specific examples of the use of the pump of this invention, the reader is to be made familiar with a few of the well parameter determinations that need be made, and the definitions thereof such as to be able to understand how these parameters impact upon the sizing of the upper barrel spacing sleeve and the probe.

Stroke Loss: The direct result of Rod Stretch, and Tubing stretch, (or elongation) ion combination with each other. Generated by the weight of the rods in combination with the weight of the fluid resting on the traveling valve. The peak load occurs at a point beginning the upstroke of the pump: the amount of stretch or elongation is governed by the following specific factors.

| EXAMPLE | Coefficient "$C_r$" | | | |
|---|---|---|---|---|
| Rod Size: | $\frac{3}{4}$" | $\frac{7}{8}$" | 1" | $1\frac{1}{8}$" |
| Plunger diameter: $1\frac{1}{2}$" | 0.69 | 0.58 | 0.39 | 0.31 |
| Plunger diameter: 2" | 1.23 | 0.90 | 0.69 | 0.55 |

Note:
The larger the rod diameter the lower the coefficient factor.

| | Coefficient "$C_t$" | | |
|---|---|---|---|
| Tubing size: | 2" | $2\frac{1}{2}$" | 3" |
| Plunger size $1\frac{1}{2}$" | .23 | .17 | .12 |
| Plunger size 2" | n/a | .30 | .21 |

The coefficient "C's" are factors recited from lookup table rod size/tubing size. $C_r$ = rod, $C_t$ = tubing
The larger the tubing, the lower the coefficient factor.

Specific Gravity:

Well Depth 10,000 =
10° API
8.328 lbs. per Gal
× 42 gal. per bbl.
× 5.79 bbls per 1000'
20,252 lbs. Fluid 10°, $2\frac{1}{2}$ tubing Well Depth 10,000 =
35° API
7.076 lbs per gal.
× 42 gal per bbl.
× 5.79 bbls. per 1000"
17,207 lbs. fluid 35°, $2\frac{1}{2}$" tubing Well Depth 10,000 =
60° API
6.151 lbs. per gal.
× 42 gal per bbl.
× 5.79 bbls. per 1000"
14,958 lbs. fluid 60°, $2\frac{1}{2}$ tubing Over travel: A direct result of the preceding factors in reverse.

Downstroke: The fall of the rod weight and fluid weight resting on the traveling valve when stopped suddenly at the bottom of the stroke, allows the traveling valve to continue its downward motion, thus overtraveling. The extent is governed by the aforementioned factors.

EXAMPLE I

The following Example illustrates the determination of the actual stroke length, as determined by the interrelationship of various operating parameters.

Example: Well depth, 10,000": anticipated stroke length 100": strokes per minute 12=31" of overtravel, thus stroke loss in a well 10,000' in depth, plunger diameter $1\frac{1}{2}$", a tapered rod string of 5000' of $\frac{7}{8}$" rod and 5000' of $\frac{3}{4}$" rods in $2\frac{1}{2}$" tubing would result in a stroke loss of 77"

$$\frac{7}{8}\text{" rods} = \frac{51 \times 5000}{10{,}000} = 25.5\text{"}$$

$$\frac{3}{4}\text{" rods} = \frac{69 \times 5000}{10{,}000} = 34.5\text{"}$$

Wherein 0.51×100=51; and 0.51 comes from a lookup table, as does the 0.69 see Harbison-Fischer supra.

| | | |
|---|---|---|
| $2\frac{1}{2}$" tubing = | | 17" |
| Stroke Loss | Total | 77" |
| Overtravel | | 31" |

-continued

| | |
|---|---|
| Total Stroke Loss | 46" |

Since the length of the stroke measured at the top of the well is 100" and the total stretch or elongation of the combined rod and tubing equals 77" the difference is 23". It then becomes obvious why it is necessary to seat the pump, then "load" or fill the tubing to the well head, then raise the pump the requred distance off bottom to allow for overtravel, as in the above example a minimum of 31". When added to the 23" it equals the traveling valve, making a stroke length of 54" as measured at the bottom of the well.

Actual stroke length=54"

Since each well as has been alluded to earlier is a separate entity, which requires the consideration of the various parameters mentioned above, one of which is the determination of actual effective pump stroke as recited in Example I, it is seen that by going through the large number of calculations, one of skill in this art can determine what size the upper barrel spacing sleeve and the probe should both be in order to effectuate gas release on each pump stroke. In order to shortcut this tedious calculation session, applicant has determined from his long history of the changes that can occur both maximally and minimally in all of the parameters that affect well operation that a quick rule of thumb calculation can be made on the basis of using a K or constant factor of about 2.5 inches per 1000 feet of well depth as the size for the upper barrel spacing sleeve. The probe is the same number expressed in inches minus about 2 to 2.5 inches.

EXAMPLE II

The following example illustrates the sizing of an upper barrel spacing sleeve under a given set of conditions utilizing data from a hand book for calculation purposes.

EXAMPLE II

A $2\frac{1}{2}''\times 2''$ bore pump at 3,500 feet in depth, with $\frac{7}{8}''$ sucker rods, at 15 strokes per minute, and a stroke length of 74" with tubing unanchored, would result in approximately 11" of sucker rod stretch and 4" of tubing stretch for a total of 15" combined stretch: with a minus 3"(−3) of overtravel nets approximately 12" of stroke loss. This equals net plunger stroke of 62" of the 74" polish rod stroke as measured at the top of the well. Using a constant "K" of $2\frac{1}{2}''$ per 1000 feet of well depth at 3,500 feet equals $8\frac{3}{4}''$ of gas release probe (#32) length, allowing a 2" clearance at the complete down stroke of the pump for ball valve member equals $10\frac{3}{4}''$ of upper barrel spacing sleeve length. Such a sleeve would provide the necessary upward valve movement and clearance to compensate for the ever changing well conditions.

Each pump available in the marketplace when assembled, is adjustable to accommodate three different stroke lengths of the pumping unit at the surface of the well. The length of the barrel is selected to accommodate the maximum stroke length. Therefore since the relative position for the gas release probe is also adjustable by clamping the polished rod clamp at a selected point on the polished rod all three stroke lengths are ensured. This adjustment allows one to determine how far he wants the probe, to penetrate and lift the ball valve element (#30) off its seat, (#26) upwardly into the interior of the upper barrel spacing sleeve (#86) yet always short of pushing the ball valve element (#30) into the interior ceiling of upper open cage, (#21).

Giving four more well depth examples using a constant "K" of $2\frac{1}{2}''\times 1000$.

| | |
|---|---|
| 4000' × $2\frac{1}{2}''$ − probe (#32) −10": | Sleeve (#86) −10" + 2" = 12" |
| 6000' × $2\frac{1}{2}''$ − probe (#32) −15": | Sleeve (#86) −15" + 2" = 17" |
| 8000' × $2\frac{1}{2}''$ − probe (#32) −20": | Sleeve (#86) −20" + 2" = 22" |
| 10,000' × $2\frac{1}{2}''$ − probe (#32) −25": | Sleeve (#86) −25" + 2" = 27" |

It is recommended that in large volume wells that the upper barrel spacing sleeve be perforated above the seat, designated 26. The perforations should be sized to equal the displaced fluid volume. The use of perforations ensures that the ball valve element 30 rides seated on the probe into the upper cage, rather than floating free into the cage. This is a means to insure that no pounding will take place.

EXAMPLE III

The following is an example of an actual pump installed in a well with a major U.S. oil company operating under a non disclosure RD test with this data.

Depth: 4935'

Stroke length: 168"

Strokes per minute: 7.3

Tapered rod string: 1450' of 1": 1725' of $\frac{7}{8}''$: 1450' of 182 "

Pump type and size: Travelling barrel $2\frac{1}{2}''\times 2''\times 24'$ with $12\frac{1}{2}''$ length gas release probe (#32) and $14\frac{1}{2}''$ upper barrel spacing sleeve length, (#86).

As shown on a Leuterert dynamometer chart, the probe lifted the ball valve member upwardly from its seat, approximately $11\frac{1}{2}''$ into the upper barrel spacing sleeve operating at approximately 82% of pump efficiency in a well heavily affected with gas.

The following Examples illustrate the test use of the pump of this invention at actual well sites at various locations owned by both major and minor oil producers.

TEST I

A device of the instant invention was installed in a well in Watford City, N.D., in place of a pump which had a pump stroke distance of 144" at 9 strokes per minute and a well depth of about 9000 ft. The well was pumping at 51 barrels per day prior to the pump change.

After the device was installed, and the depth maintained (since the same well was used), and the stroke was shortened to 128" (contrary to the action one would normally take to increase production), and the number of strokes per minute was maintained at 9, the yield was increased to 134 barrels per day for the two days applicant was present at the job site.

TEST II

At a Skyline Oil Co. well in Price, Utah where the pump of the type claimed in the instant patent application was used in place of the pump in the well, and wherein the depth of well was maintained, the stroke rate maintained and all other parameters were maintained, the yield was increased from 40 barrels per day up to 154 barrels per day.

The efforts of the applicant were over seen by corporate personnel of Skyline Oil, a division of Texas Eastern Drilling Co. of Houston Tex.

At another well located in the same Utah field, without changing the operating parameters upon the replacement of the pump by the instant device the yield went from 200 barrels per day to 400 barrels per day.

Thus, I have described a gas release probe which can be easily applied to the travelling barrel of a conventional downhole pump by merely lengthening such barrel by providing a spacing sleeve above the travelling valve. The trip rod of the probe lifts the ball of the travelling valve to release any gas otherwise trapped between the lower standing valve and the upper travelling valve. Such gas release takes place on each stroke of the pump. The invention is useful for obtaining oil out of pumps under subterranean formation conditions that do not normally permit such recovery.

Use of the gas release probe disclosed herein in conventional pumps would result in less danger to such pumps due to gas pockets or foamy oil conditions encountered in pumping certain well formations.

My invention has wide application since almost all wells have gas associated therewith and the amount of such wells affected by production loss, energy waste and pump inefficiency due to gas lock may be very high, such as 70 to 80 percent of such wells. The gas release probe disclosed herein solves such problem quickly and relatively inexpensively.

The pump disclosed herein will move either fluid or gas in a positive manner at each complete pump cycle regardless of pressure differential across the valves. The spacing sleeve allows for normal pump spacing since the upper valve member is free to travel up or down above its seat whatever distance may be required. The rod of the probe lifts the ball valve from its seat gently and reseats it in the same manner without any significant hammering, pounding or heavy impact on the seat. The invention disclosed herein ensures that the pump will operate efficiently with no downtime due to gas lock. Flow of fluid or gas from the subterranean formation to the surface is not retarded by formation pressure buildup. The entire unit has few working parts, is totally encapsulated and can be quickly and easily removed, inspected, repaired, if necessary, and re-installed.

Although a specific arrangement of components has been disclosed, and mechanical means for interconnecting the various parts, obviously other mechanical means may be used.

The various parts may be of any suitable dimensions and materials to carry out the invention.

Since certain changes may be made in the above article without departing from the scope of the invention herein involved, it is intended that all matter contained in the above description and shown in the accompanying drawings shall be interpreted as illustrative and not in a limiting sense.

I claim:

1. An improved down hole pump comprising:

a. a fixed lower standing first valve having an opening leading into a first open end thereof;

b. a first valve seat in said valve, having an opening normally closed by a c. valve element freely movable in said valve and of a diameter sufficient to close off the opening of said valve seat, said valve having a second open end with a reduced neck opening of a diameter less than the diameter of said valve element, said seat being disposed between said first and second open ends;

d. a tubing, fixed to said valve and extending upwardly therefrom, and in fluid communication with the interior of said valve, said tubing also being fixed to e. a midwardly disposed cage;

f. a travelling barrel encircling said tubing, and said midwardly disposed cage and movable with respect to said tubing and cage;

g. a gas relief, valve lifting, probe means in the form of an enlarged rod mounted within said barrel, said probe means being free at its upper end for travel, said probe means at its opposite end being fixed to he upper end of the midwardly disposed cage and extending upwardly therefrom, said gas relief, valve lifting, probe having at its lower end openings in fluid communication with the interior of the travelling barrel, said probe, having a minimal finite length determined by the operational parameters of the well in which the down hole pump is to be utilized, and said probe also terminating at its uppermost point with a concave radius;

said travelling barrel having its lower end provided with a h. guide bushing, said guide bushing having an inside diameter greater than the outside diameter of the aforementioned tubing, and encircling said tubing and movable with respect thereto, said guide bushing also having an inside diameter less than that of the aforementioned midwardly disposed cage, while said midwardly disposed cage has a greater outside diameter than said guide bushing, which is necessary, in order to pull the pump as a complete assembly;

and the aforementioned travelling barrel's upper end being coupled to i. a variable length upper spacing sleeve, preferably via an interposed adapter, the said spacing sleeve being in fluid communication with the interior of said travelling barrel, the upper barrel spacing sleeve being sized in length slightly greater than the length of said gas relief probe, said upper surface sleeve having a seat retaining base normally disposed at any location from the bottom thereof to a point along the elevation thereof, distant from said upper cage, j. a second valve seat having an opening in fluid communication with said upper spacing sleeve, and being provided with a valve seat retaining shoulder;

k. a second valve element freely movable in said upper spacing sleeve and having a diameter sufficient to close off the opening in said second valve seat, l. an upper cage in fluid communication with said upper spacing sleeve, and being provided with openings less than the diameter of said second valve element, the upper cage adapted for fluid communication with the well production tubing, said upper cage being sealed at its upper interior and being adapted for connection to a sucker rod string of a well riser;

whereby after the pump is seated in the down stroke position, as the first half of the cycle, the travelling barrel rises on the up stroke thus allowing the first valve element to unseat, such that fluid enters through the first open end through the narrow open first valve, through the open tubing through the hollow piston out the openings at the lower end of the valve lifting probe into the travelling barrel above the piston; and on the second half of the cycle, the down stroke, the travelling barrel descends compressing the fluid between the first valve and the second valve, such that at the point when the compression differential between the valves is insufficient to unseat the upper travelling valve, due to the presence of gases the valve lifting probe passes into the upper barrel spacing sleeve, through the opening of the valve seat, connecting the valve element and thus lifting said element off its seat upwardly into the confines of the upper spacing chamber to a height short of pushing the valve element into the top of upper cage and causing pump damage thereby permitting the trapped gases to escape a quantum at a time of each pump cycle.

2. In the pump of claim 1 wherein said probe means includes an elongated rod fixed to said midwardly disposed cage, said rod extending vertically coincident with the central axis through said second valve opening.

3. In the pump of claim 1 wherein the overall length of said rod is less than the overall length of said spacing sleeve.

4. In the down hole pump of claim 1 wherein the travelling barrel's upper end is coupled to the upper barrel spacing sleeve by an interposed adapter.

5. In the pump of claim 4 wherein the diameter of said rod is less than the width of the opening in said second valve seat.

6. In the down hole pump of claim 1, wherein said gas relief probe has a concave upper surface, and said probe is disposed entirely within said travelling barrel and below said upper cage, when said travelling barrel moves from its up stroke to its downstroke position, the overall length of said upper spacing sleeve, alone, or in conjunction with the aforementioned adapter, being long enough to permit said probe to extend substantially completely into the interior of said upper spacing sleeve to gently unseat said second valve element, and move said second valve element upwardly into the upper cage, but not as high as the top of the upper cage, and then gently reseat same, thereby extending the life of the said second valve element.

7. In the pump of claim 6 wherein said second valve element is spherical in configuration.

8. In the pump of claim 1 wherein said second valve element is a ball and said rod terminates in a concave portion configured similarly to the outer configuration of said ball.

9. In the pump of claim 8 wherein a threaded adapter is interposed between the upper barrel spacing sleeve and the upper end of the travelling barrel.

* * * * *